United States Patent [19]

Felix

[11] Patent Number: 4,877,177

[45] Date of Patent: Oct. 31, 1989

[54] WINDOW LETTER

[75] Inventor: Willi Felix, Strengelbach, Switzerland

[73] Assignee: Jos. Hunkeler Ltd., Wikon, Switzerland

[21] Appl. No.: 58,050

[22] Filed: Jun. 4, 1987

[30] Foreign Application Priority Data

Jun. 6, 1986 [CH] Switzerland ..... 02312/86

[51] Int. Cl.[4] ..... B65D 27/00

[52] U.S. Cl. ..... 229/92.3; 229/71

[58] Field of Search ..... 229/71, 73, 92.3

[56] References Cited

U.S. PATENT DOCUMENTS 1,708,574 4/1929 Hazer ..... 229/92.3
3,043,732 7/1962 Shepherd, Jr. .
3,143,279 8/1964 Black ..... 229/92.3
3,482,780 12/1969 Johnsen .
3,550,841 12/1970 Berkley .
3,693,869 9/1972 Eaves, Jr. .
4,598,860 7/1986 Pennock ..... 229/92.3

FOREIGN PATENT DOCUMENTS 0138413 4/1985 European Pat. Off. .
609634 3/1979 Switzerland .

*Primary Examiner*—Willis Little
*Attorney, Agent, or Firm*—Davis Hoxie Faithfull & Hapgood

[57] ABSTRACT

A letter form, which serves as both letter and window envelope, wherein the address is reverse printed on the inside of the window cover film and does not dictate the arrangement and design of the printed text of the letter form and wherein the address is readable when inserts are included. Preparation of the letter form advantageously includes printing of text and address concurrently.

50 Claims, 2 Drawing Sheets

WINDOW LETTER

BACKGROUND OF THE INVENTION

1. Field of the Invention

This invention relates to production from a single, printable sheet of paper or the like, of a letter form, which serves as both letter and envelope.

2. Description of the Prior Art

Letter forms of this type consisting of a single sheet and, when folded, made up of two or several leaves lying one atop another, joined together to form a self-contained letter/envelope are known, for example, from Swiss Patent No. 609,634 and U.S. Pat. No. 3,482,780. In these types of letter form, the inner side of the sheet is printed with information and a mailing address. The sheet is then folded once or twice and the two or three sheet-parts are stuck together along their edges. With the exception of the address, the lettering on the inner side of the sheet is thus covered. The latter is visible through a window. The address area with the address of the addressee, located on one sheet-part, and the window which is to be provided on the other sheet-part must therefore be arranged in such a manner that they lie opposite one another when the sheet is folded. The consequence of this is a lack of freedom in the choice of where the address area and window are to be arranged, especially if the position at which the address is to appear on a letter is governed by existing postal regulations.

Furthermore, the known letter forms consisting of two parts have the disadvantage that it is impossible to insert an enclosure between the folded halves of the sheet since this would obscure the address area, unless the enclosure is both too small to cover up the address area and also is secured so that it cannot slip in front of the address area.

It is an object of the present invention to provide a letter form giving greater freedom in the arrangement of the address area and the window than with known letter forms and with which there is no risk of the address being unintentionally covered by any enclosures inserted.

It is a further object of the present invention to provide a process which permits the production, in a simple manner, of such letter forms.

These and other objects are achieved by the article and process described herein and illustrated by the accompanying drawings.

SUMMARY OF THE INVENTION

The letter form, according to the present invention, comprises a single printable sheet containing a preselected window opening bearing a cover. On the inside surface of the sheet is printed the letter or other information to be sent. On the inside of the window cover is reverse-printed the addressing information. When folded and sealed, the letter form provides a self-contained envelope with the addressing information readable through the window.

Since, according to the invention, the address or information relating to the recipient are no longer printed on one of the sheet-parts but on the rear side of the window cover and the address area thus lies on the rear side of the window cover, the provision of an address area on the other sheet part is unnecessary. The address area is therefore no longer a necessarily determining factor for the arrangement of the printed text, i.e., information to be printed on the inner side of the sheet.

Furthermore, the window can be arranged in any suitable position or, where applicable, in the prescribed position without this having any serious consequences for the arrangement and design of the imprint (text, tables and the like) to be applied to the inner side of the sheet. Further, the address or the recipient's identification code cannot be covered over by inserted enclosures.

The application of the address or the recipient's identification code in mirror writing to the rear side of the window ensures that the appearance of the lettering from the front side of the window is as normal and can therefore be read without difficulty.

DESCRIPTION OF THE PREFERRED EMBODIMENTS

Figure 1:
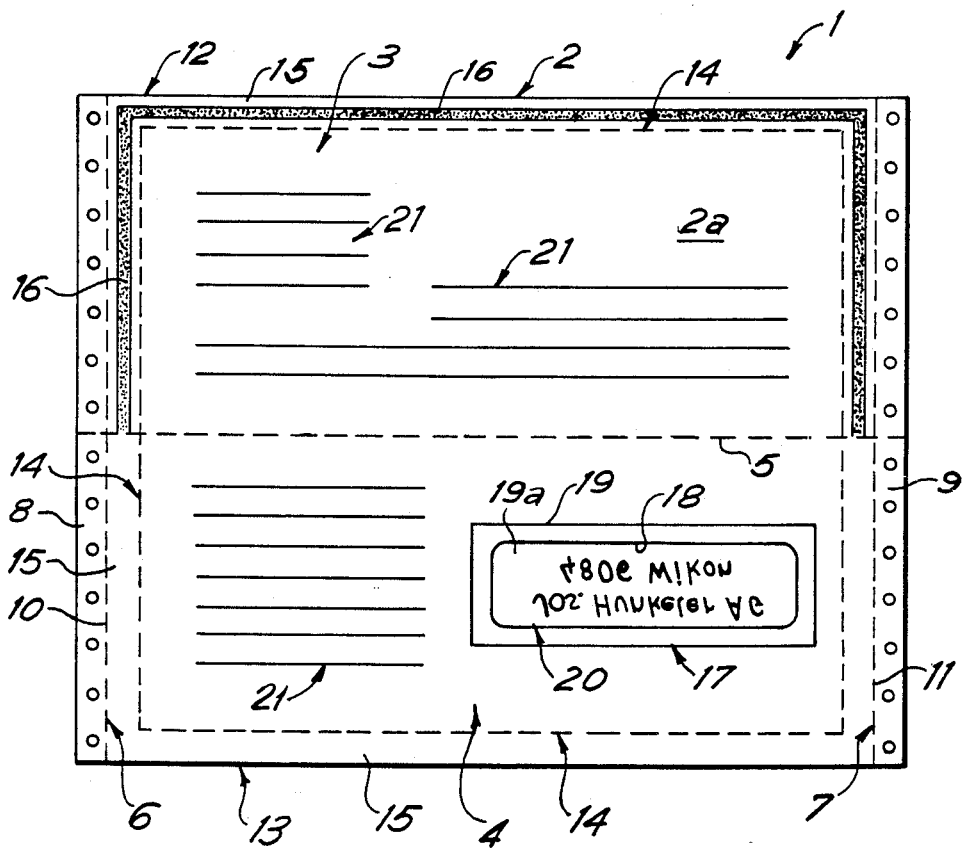
FIG. 1 shows a plan view of the inner side of a sheet of a single-fold embodiment of a letter form according to this invention.
Figure 2:
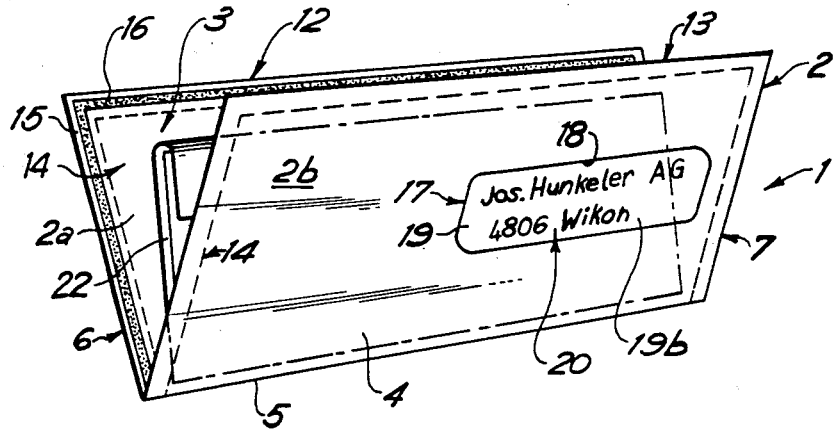
FIG. 2 shows a perspective view of the sheet of FIG. 1, folded once and in the half-open condition, with an enclosure inserted.
Figure 3:
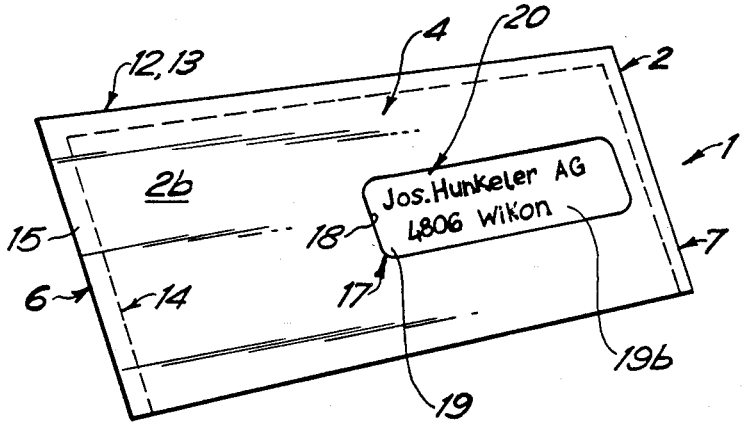
FIG. 3 shows an oblique view, from the front, of the sealed letter form of FIG. 1.

The letter form 1 shown in FIGS. 1–3 consists of a sheet 2, the inner side of which is designated **2*a* and the outer side of which is designated 2*b*. The sheet 2 has end edges 12, 13. The sheet consists of two halves 3 and 4, which are divided by a transverse fold line 5, applied in known manner. Both halves 3, 4 of the sheet are provided at the lateral edges 6, 7 with edge strips 8, 9 having sprocket holes (FIG. 1) for registered conveying, as is known to workers in the field. These edge strips 8, 9 can be torn off along separation lines 10, 11. There is a peripheral separation line 14, applied in known manner, at a distance from the lateral edges 6 and 7 as well as end edges 12 and 13. Together with the edges 6, 7, 12, 13 this defines a peripheral edge section 15. The part of the edge section 15 which is located in sheet-half 3 carries adhesive strip 16**.

Sheet-half 4 is provided with an address window 17 which is formed by an opening 18 in sheet-half 4. This opening 18 is covered over by a cover film 19, the rear side of which corresponds to inner side **2*a* of sheet 2 and is designated 19*a* and the front side of which corresponds to outer side 2*b* of sheet 2 and is designated 19*b*. An address 20, which typically is a post office address but might be an addressee's identification code, for example, is applied in mirror writing, i.e., in a script which is the wrong way round, where right and left are reversed, to the rear side 19*a* of the cover film 19, as can be seen from FIG. 1. Cover film 19, when printed, is a see-through cover; that is, it is sufficiently transparent or translucent that addressing information 20 can easily be read through the film. In the area beyond the window 17, the inner side 2*a* of the sheet 2 is provided with an imprint 21, e.g., text, numbers, tables and the like. However, it is not necessary to provide an address area on sheet-half 3 since this is located on the rear side 19*a* of the cover film 19**.

The production of the letter form 1 described above proceeds as follows.

Printing of address 20 advantageously is done concurrently with, that is, simultaneously with, or consecutively to, printing of all or at least a portion of imprint 21. The unfolded sheet, however, may have been preprinted on the outer side 2b and, at least to a certain extent, also on the inner side 2a. Typically, imprint 21 is provided on inner side 2a by means of an electronically controlled printer, e.g., a laser printer or an ink-jet printer. In addition, the address 20 is applied in mirror writing to the rear side of the cover film 19a covering window 17. Application of adhesive strip 16 may be performed by conventional means either before or after printing of imprint 21 and address 20.

Folding and sealing is performed after printing and after application of the adhesive strip. After the imprint 21 and address 20 have been applied, the hole-bearing edge strips 8, 9 are torn away, preferably prior to folding. The sheet 2 is then folded along the fold line 5. Prior to sealing, an enclosure 22 may be inserted between the sheet-halves 3, 4, which lie one on top of the other, as shown in FIG. 2. Finally, the two sheet-halves 3, 4 are stuck together along their edges 6, 7, 12, 13 by means of the adhesive strip 16. FIG. 3 shows letter form 1 folded, sealed and ready to be sent.

As shown in FIGS. 2 and 3, the address 20, which was applied beforehand in mirror writing to the rear side 19a of the cover film 19, is correct as seen from the front side 19b of the cover film 19, i.e., it is no longer the wrong way round. The enclosure 22 lying behind the window 17 does not hide the address 20. When the sheet halves 3, 4 are folded one on top of the other, the lettering 21 is covered and cannot be seen from outside.

To open the sealed letter form 1, the edge section 15 is torn away along the separation line 14.

As stated above, cover film 19 can be transparent or somewhat opaque, e.g., milky, just so that even in the latter case the address 20 can be read. The entire film 19 need not be transparent. It is required only that the address be readable. This can be achieved, for example, by use of an otherwise unacceptably opaque cover film 19 which becomes see-through, i.e., transparent or translucent, during printing at those points at which the address 20 is imprinted. Materials for such covers are known to workers in the field. It will be understood that use of an appropriate non-transparent cover film 19 will permit printing on that portion of inner side 2a which in the folded article will lie below cover film 19, without interfering with the readability of address 20.

Figure 4:
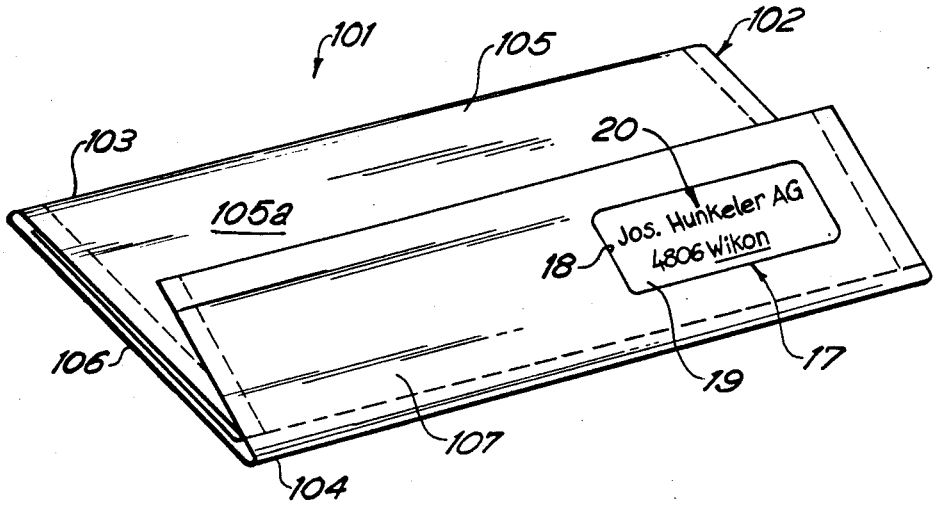
FIG. 4 shows an oblique view of a three-fold embodiment of a letter form according to this invention.

Another embodiment of this invention is shown in FIG. 4. In this embodiment the letter form is folded twice to produce the final article.

In the case of a letter form 101 of this type (FIG. 4), the sheet 102 has two fold line 103, 104 running at some distance from one another and dividing the sheet 102 into three sections 105, 106, 107, namely a middle section 106 and two outer sections 105, 107. The window 17 with the address 20, which is applied in mirror writing to the rear side of the cover film 19 of the window 17, is here arranged in one of the outer sections 107. The sheet 102 is then folded in such a way that the sheet section 107 having the window 17 is laid above the other outer sheet section 105 so that the window 17 comes to rest on the unprinted rear side 105a of this other outer sheet section 105.

As will be noted from the embodiments described above, the folded sheet 2, 102 may consist of a single leaf or several leaves lying one on top of the other and connected to each other.

What is claimed is:

1. A process for the production of a ready-to-mail letter form from a single sheet comprising the steps of:

a. providing a printable and foldable single sheet with a preselected window opening, said sheet having an inside major surface comprising horizontal top and bottom edges and vertical left side and right side lateral edges;

b. affixing to said major surface a see-through cover over said window opening, said cover having an inside cover surface corresponding to the inside major surface of said sheet;

c. printing information to be sent on said inside major surface;

d. printing in mirror writing addressing information on said inside cover surface;

e. folding said sheet at least once, whereby said addressing information is readable through the cover over the window opening; and f. securing said sheet in its folded state.

2. A process according to claim 1 wherein said single sheet additionally includes, along said lateral edges, tear-away edge strips having sprocket holes, and wherein said process further comprises the step of tearing away said edge strips prior to folding said sheet.

3. A process according to claim 1 wherein said printable and foldable single sheet comprises at least two leaves lying one atop the other and joined together at least along an edge.

4. A process according to claim 1 wherein printing on said inside major surface and printing on said inside cover surface are performed concurrently.

5. A process according to claim 1 wherein said addressing information is printed upside down with respect to said information to be sent.

6. A process according to claim 1 wherein said see-through cover is normally opaque but becomes see-through at those points on which addressing information is printed.

7. A process according to claim 1 wherein said single sheet includes a central, horizontal transverse fold line and wherein said folding step comprises folding said sheet along said fold line.

8. A process according to claim 7 further comprising the step of inserting an enclosure before securing said sheet in its folded state.

9. A process according to claim 1 wherein said provided single sheet is divided by two horizontal transverse fold lines into three horizontal sections, a middle section and two end sections, a first end section selected to be the front of said letter form after folding and a second end section, wherein said preselected window opening is located in the first end section, and wherein said sheet is folded along each horizontal fold line such that said first end section lies atop the second end section.

10. A process according to claim 9 comprising the additional step of inserting an enclosure before securing said sheet in its folded state.

11. A process according to claim 1 wherein the step of printing in mirror writing is performed with an electronically controlled printer.

12. A process for the production of a ready-to-mail letter envelope from a single sheet comprising the steps of:

a. providing a printable and foldable single sheet having an inside major surface comprising horizontal top and bottom edges and vertical left side and right side lateral edges;
b. cutting in said sheet an address window opening at a preselected location;
c. applying near at least one horizontal edge of said inside major surface a first adhesive strip;
d. affixing to said inside major surface a see-through cover over said window opening, said cover having an inside cover surface corresponding to the inside major surface of said sheet;
e. printing information to be sent on said inside major surface;
f. printing in mirror writing addressing information on said inside cover surface;
g. folding said sheet at least once to form an envelope wherein said addressing information is readable through the see-through cover over the window opening; and
h. closing said envelope by pressing said first adhesive strip to the juxtaposed sheet portion after folding.

13. A process according to claim 12 wherein said single sheet additionally includes, along said lateral edges, tear-away edge strips having sprocket holes, and wherein said process further comprises the step of tearing away said edge strips prior to folding said sheet.

14. A process according to claim 12 wherein said see-through cover is normally opaque but becomes see-through at those points on which addressing information is printed.

15. A process according to claim 12 wherein printing of said information to be sent and the printing in mirror writing of said addressing information is done concurrently.

16. A process according to claim 12 wherein said printable and foldable single sheet comprises at least two leaves lying one atop the other and joined together at least along an edge.

17. A process according to claim 12 wherein said addressing information is printed upside down with respect to the information to be sent.

18. A process according to claim 12 wherein the step of printing addressing information precedes the step of applying a first adhesive strip.

19. A process according to claim 12 wherein the step of printing in mirror writing is performed with an electronically controlled printer.

20. A process according to claim 12 further comprising the step of applying to said sheet a central, horizontal transverse fold line and wherein said folding step comprises folding said sheet along said fold line.

21. A process according to claim 20 further comprising the step of perforating said sheet near the top and bottom edges to form separable horizontal borders, and wherein said first adhesive strip is applied to at least one of said horizontal borders.

22. A process according to claim 21 further comprising the step of perforating said sheet near the lateral edges to form separable lateral borders, and the step of applying second strips of adhesive to said lateral borders, and wherein said closing step includes pressing said second adhesive strips to the juxtaposed sheet portions, whereby said envelope comprises an essentially sealed article having three tear-open strips comprising the separable borders.

23. A process according to claim 22 wherein the steps of perforating said sheet to form said horizontal and lateral borders perforate said sheet only between said borders, whereby said three tear-open strips form a single continuous strip of said separable borders.

24. A process according to claim 21 comprising the additional step of inserting an enclosure before closing said envelope.

25. A process according to claim 12 further comprising the step of applying to said sheet two horizontal fold lines, thereby dividing said sheet into a middle section and two end sections, a first end section and a second end section; wherein the preselected location for said window opening is in the first end section; wherein said first adhesive strip is applied to said first end section; and wherein said folding step comprises folding said sheet along each horizontal fold line such that said first end section lies atop the second end section.

26. A process according to claim 25 further comprising the step of perforating said sheet near the lateral edges to form separable left side and right side lateral borders and the step of applying second strips of adhesive to preselected areas of each of said lateral borders, such that upon closing, each of said left side and right side borders comprises a tear-open strip of three adhered layers.

27. A process according to claim 26 further comprising the step of inserting an enclosure before closing said envelope.

28. A process for the production of a ready-to-mail letter form from a printable and foldable single sheet having an inside major surface comprising horizontal top and bottom edges and vertical left side and right side lateral edges, said sheet further comprising a window opening and a see-through cover over said window opening, said cover having an inside surface corresponding to the inside major surface of said sheet, comprising the steps of:
a. printing information to be sent on the inside major surface of said sheet;
b. printing addressing information in mirror writing on said inside cover surface;
c. folding said sheet at least once, wherein said addressing information is readable through said cover; and
d. securing said sheet in its folded state.

29. A process according to claim 28 wherein said single sheet additionally includes, along said lateral edges, tear-away edge strips having sprocket holes, and wherein said process further comprises the step of tearing away said edge strips prior to folding said sheet.

30. A process according to claim 28 wherein printing on said inside major surface and printing on said inside cover surface are performed concurrently.

31. A process according to claim 28 wherein said addressing information is printed upside down with respect to said information to be sent.

32. A process according to claim 28 wherein said step of printing in mirror writing is performed with an electronically controlled printer.

33. A process according to claim 28 wherein said single sheet comprises at least two leaves lying one atop the other and joined together at least along an edge.

34. A process according to claim 28 wherein said sheet includes a central horizontal fold line and wherein said folding step comprises folding said sheet along said fold line.

35. A process according to claim 34 wherein said sheet includes perforation lines which form separable horizontal borders along said horizontal top and bottom edges, wherein said process further comprises the step, prior to folding, of applying adhesive to at least one of said horizontal borders, and wherein said folding step comprises folding said sheet once to bring said horizontal borders together in matching relationship, thereby providing a tear-open strip for the secured, folded sheet.

36. A process according to claim 35 wherein said sheet includes perforation lines which form separable lateral borders along said lateral edges, and wherein said process further comprises the step, prior to folding, of applying adhesive to said lateral borders, thereby providing three tear-open strips for the secured, folded sheet.

37. A process according to claim 36 wherein said perforation lines extend only between borders, whereby said three tear-open strips form a single continuous strip of said separable borders.

38. A process according to claim 35 further comprising the step of inserting an enclosure before securing said sheet in its folded state.

39. A process according to claim 28 wherein said single sheet is divided by two horizontal fold lines into three horizontal sections, a middle section, a first end section preselected to bear the address information of said letter form in its folded state and a second end section, wherein said window opening is located in said first end section, and wherein said folding step comprises folding said sheet along each horizontal fold line such that said first end section lies atop the second end section.

40. A process according to claim 39 wherein said single sheet includes perforations which form separable lateral borders along said lateral edges, and wherein said process further comprises the step, prior to folding, of applying adhesive to said lateral border regions.

41. A process according to claim 39 further comprising the step of inserting an enclosure before securing said sheet in its folded state.

42. A letter form comprising a. a single sheet printable on an inside major surface having a top edge, a bottom edge and two side edges;

b. at least one transverse fold line across said sheet;

c. a window opening in said sheet at a preselected location suitable as an appropriate address location upon folding of the sheet to a ready-to-mail configuration;

d. a see-through cover affixed to said sheet and covering said window opening, said cover having an inside surface corresponding to the inside major surface of said sheet;

e. textural information printed on the inside major surface of said sheet; and f. address information printed in mirror writing on the inside surface of said cover.

43. A letter form according to claim 42 further comprising lateral tear-away edge strips having sprocket holes.

44. A letter form according to claim 42 wherein said single sheet comprises at least two leaves lying one atop the other and joined together at least along an edge.

45. A letter form according to claim 42 wherein said cover is see-through only at those points on which address information is printed.

46. A letter form according to claim 42 wherein said address information is printed upside down with respect to said textural information.

47. A letter form according to claim 42 comprising a central transverse fold line; transverse perforation lines near said top and bottom edges, forming tear-away top and bottom borders; and a first adhesive strip applied to at least one of said top and bottom borders.

48. A letter form according to claim 47 further comprising perforation lines near said side edges, forming tear-away side borders, and second adhesive strips applied to said side borders, wherein said form comprises an unfolded envelope essentially sealable around its periphery by folding along said fold line and pressing the folded sheet, which envelope is convertible to a folded letter by removal of said tear-away borders.

49. A letter form according to claim 48 wherein said perforation lines extend only between borders, whereby said tear-away borders form a single continuous strip.

50. A letter form according to claim 42 wherein said at least one transverse fold line is two fold lines dividing said sheet into a middle section and two end sections, a first end section and a second end section, and wherein the preselected location for said window opening is in the first end section, said letter form being foldable along said fold lines such that said first end section will lie atop said second end section, said letter form further comprising perforation lines near said side edges forming tear-open borders, and adhesive strips applied to preselected areas of said side borders which, upon folding along said fold lines and pressing, yield essentially sealed, three-layer, tear-away side borders of the folded letter form.

* * * * *